US007828057B2

(12) United States Patent
Kearl et al.

(10) Patent No.: US 7,828,057 B2
(45) Date of Patent: Nov. 9, 2010

(54) MICROWAVE PROCESS FOR INTRINSIC PERMEABILITY ENHANCEMENT AND HYDROCARBON EXTRACTION FROM SUBSURFACE DEPOSITS

(75) Inventors: Peter M. Kearl, Grand Junction, CO (US); Donald L. Ensley, Bodega Bay, CA (US)

(73) Assignee: Geoscience Service, Grand Junction, CO (US)

( * ) Notice: Subject to any disclaimer, the term of this patent is extended or adjusted under 35 U.S.C. 154(b) by 417 days.

(21) Appl. No.: 11/805,906

(22) Filed: May 25, 2007

(65) Prior Publication Data

US 2007/0289736 A1 Dec. 20, 2007

Related U.S. Application Data

(60) Provisional application No. 60/808,890, filed on May 30, 2006.

(51) Int. Cl.
*E21B 43/24* (2006.01)
*E21B 36/00* (2006.01)

(52) U.S. Cl. ..... 166/248; 166/57; 166/65.1; 166/302

(58) Field of Classification Search ..... 166/248, 166/301, 60, 65.1, 57, 572
See application file for complete search history.

(56) References Cited

U.S. PATENT DOCUMENTS

| | | | | |
|---|---|---|---|---|
| 2,801,715 | A * | 8/1957 | Hall, Sr. | 166/290 |
| 4,182,414 | A * | 1/1980 | Sanders et al. | 166/74 |
| 4,620,593 | A * | 11/1986 | Haagensen | 166/248 |
| 5,299,887 | A * | 4/1994 | Ensley | 405/128.65 |
| 6,012,520 | A * | 1/2000 | Yu et al. | 166/245 |
| 2008/0265654 | A1 * | 10/2008 | Kearl et al. | 299/14 |

* cited by examiner

*Primary Examiner*—Giovanna C Wright
(74) *Attorney, Agent, or Firm*—Edwin L. Hartz

(57) ABSTRACT

Hydrocarbons are extracted from a target formation, such as oil shale, tar sands, heavy oil and petroleum reservoirs, by apparatus and methods which cause fracturing of the containment rock and liquification or volatization of the hydrocarbons by microwave energy directed by a radiating antenna in the target formation.

10 Claims, 6 Drawing Sheets

MICROWAVE PROCESS FOR INTRINSIC PERMEABILITY ENHANCEMENT AND HYDROCARBON EXTRACTION FROM SUBSURFACE DEPOSITS

CROSS REFERENCE TO RELATED APPLICATIONS

This Application claims priority to Provisional Application U.S. Application No. 60/808,890 filed May 30, 2006.

FIELD OF THE INVENTION

The present invention relates to the extraction and recovery of subsurface hydrocarbon deposits by a process of microwave radiation and permeability enhancement of reservoir rocks due to fracturing by selective and rapid heating.

BACKGROUND OF THE INVENTION

Oil shale, tar sands, oil sands and subsurface media in specific areas contain useful hydrocarbons. For example, it has been reported that there are vast oil shale deposits in the United States, and in particular, in the States of Colorado, Utah and Wyoming; with over 1.5 trillion barrels of oil in the oil shale in these States. There have been many attempts to extract the hydrocarbons from these subsurface deposits.

Some of these applications involve removal of the subsurface media to above ground and the use of a retort to remove the oil. To avoid the step of excavating or mining, a number of in-situ processes have been proposed.

One such proposal employs relatively low microwave power supplied by a magnetron. The down hole microwave generator is disclosed in U.S. Pat. No. 4,193,448 issued Mar. 18, 1980 to Calhoun G. Jeambey, as inventor, and the use of this generator is disclosed in detail in U.S. Pat. No. 4,817,711 issued Apr. 4, 1989 to Calhoun G. Jeambey as inventor. The microwave generator is a mixer apparatus similar to those used in microwave ovens and is relatively ineffective for controlled heating and removing of hydrocarbons. The apparatus heats the easily reached hydrocarbons in the pores of the rock and will leave much of the hydrocarbon away from the bore hole untouched.

Although not designed for commercially recovering hydrocarbons from oil shale or other subterranean locations, a high power microwave system is disclosed in U.S. Pat. No. 5,299,887 issued Apr. 5, 1994 to Donald L. Ensley, one of the inventors herein. This system is disclosed for the removal of contaminant from a sub-surface soil matrix. It is taught in this patent that the application of high power microwave energy to chlorinated hydrocarbons contaminated (CHC) soil causes micro-fractionation of various soil aggregates, including clay and rock formations. This effect increases the local permeability and resulting diffusion rates for egress of both liquid and vapor phase CHC.

The teachings of the Ensley U.S. Pat. No. 5,299,887 patent were included in U.S. Pat. No. 6,012,520 by Andrew Yu and Peter Tsou as an alternative to use of high-pressure water jet drilling to create a high-permeability web in a hydrocarbon reservoir.

SUMMARY OF THE INVENTION

The present invention provides a new economical way of recovering oil contained in a rock formation, such as oil shale, by enhancing the permeability of the subterranean rock by selective and rapid heating. The basic concept taught by the co-inventor Ensley is built upon for efficient recovery of oil from oil shale and of oil from tar sands. Additionally, the residual oil from worked and/or abandoned oil wells may be recovered by the apparatus and method of this invention.

The method of extracting oil from oil shale, tar sands and oil sands includes the steps of drilling a bore hole into the media, encasing the hole with a casing and a fused quartz or other low dielectric material extension or well screen at the bottom of the casing, inserting a microwave carrier with a directional antenna at the bottom end into the uncased well and the fused quartz well screen, and radiating electromagnetic energy at microwave frequencies from the antenna into the media surrounding the antenna.

The apparatus includes a high power (½ megawatt or greater) microwave source which operates at 1 Gigahertz or higher frequency coupled through a waveguide or coaxial cable to a directional antenna in a well. The typical frequency for the microwave source is 2.45 Gigahertz. The apparatus further includes a circulator in the waveguide path near the output of the source to protect the source from reflected waves. The circulator directs any reflected waves to a dummy load. A casing, inside the drilled hole and containing the waveguide, provides a path for passage of vaporized water and vaporized or liquified hydrocarbons from the bottom of the well to the top for collection and management and recovery of the hydrocarbons. The fluids are either pumped or rise because of sufficient pressure created by the heating and vaporizing of water and hydrocarbons.

The apparatus may further include a rotator in the waveguide going into the well to permit rotation of the lower waveguide and antenna for selecting the direction of radiation from the antenna.

The apparatus and method of the present invention provide extraction of hydrocarbons from subsurface deposits, which include, but are not limited to, oil shale, tar sands, heavy oil, and residual oil from petroleum reservoirs by microwave (greater than 1 GHz frequency) radiation that vaporizes hydrocarbons or decreases hydrocarbon viscosity for removal by conventional pumping technologies.

Further, the intrinsic permeability of the host rock is increased by fracturing the rock as a result of rapid microwave heating of the in-situ fluids. The process of increasing the intrinsic permeability of the hydrocarbon reservoir rock enhances hydrocarbon removal efficiencies during microwave heating. A pressure bubble in permittivity space may be created that contains the migration of hydrocarbons from the source region to the extraction bore hole.

The apparatus and method of this invention provide an enhanced zone of intrinsic permeability surrounding bore holes that increases production rates for new or existing wells located in subsurface gas or petroleum reservoirs. A permeable skin region is created around the well bore that extends several meters radially from the well bore.

The apparatus and method provides a way to remove the hydrocarbons with minimal impact to the environment. A single bore hole is drilled to extract hydrocarbons leaving no waste, such as clay waste piles, which require additional disposal methods. Additionally, water requirements from limited water resources are minimized by use of this apparatus and method.

Further efficiencies are realized by capturing and employing some of the volatile vapor emissions as fuel to power the field portable microwave system; thus, limiting fuel supplies from other sources. Gas turbines may be easily employed in this way. The net result is an increase in the energy balance where judicious quantities of energy are used to economically produce portable forms of energy that have a minimal impact on the environment.

Further, the impact on groundwater resources is minimized or avoided by containing the hydrocarbon removal process to the vertical region of extraction while not disturbing upper or lower layers of water.

The system for extracting and recovering hydrocarbons from subsurface target formations may be a closed system downhole with pressure control to most effectively extract hydrocarbons from rock, such as oil shale. Oil shale typically contains 2% to 4% of water. If there is insufficient water in the target formation, water may be added through the encased bore hole.

The water in the target formation is superheated and causes fracturing of the rock. Further, the superheated water, from the target formation or added, causes the pressure to increase to push the liquified or volatized hydrocarbon to the surface. These hydrocarbons are collected in a tank and recovered.

The pressure created by the superheated water or steam may be controlled by controlling the microwave power applied to the antenna positioned in the target formation. Further, the frequency of the output of the microwave source may advantageously be 2.45 Gigahertz, which is the closest frequency to the resonance of water.

The above and other features, objects and advantages of this invention will become apparent from a consideration of the foregoing and the following description, the appended claims and the accompanying drawings.

DETAILED DESCRIPTION OF THE PREFERRED EMBODIMENTS

Figure 1:
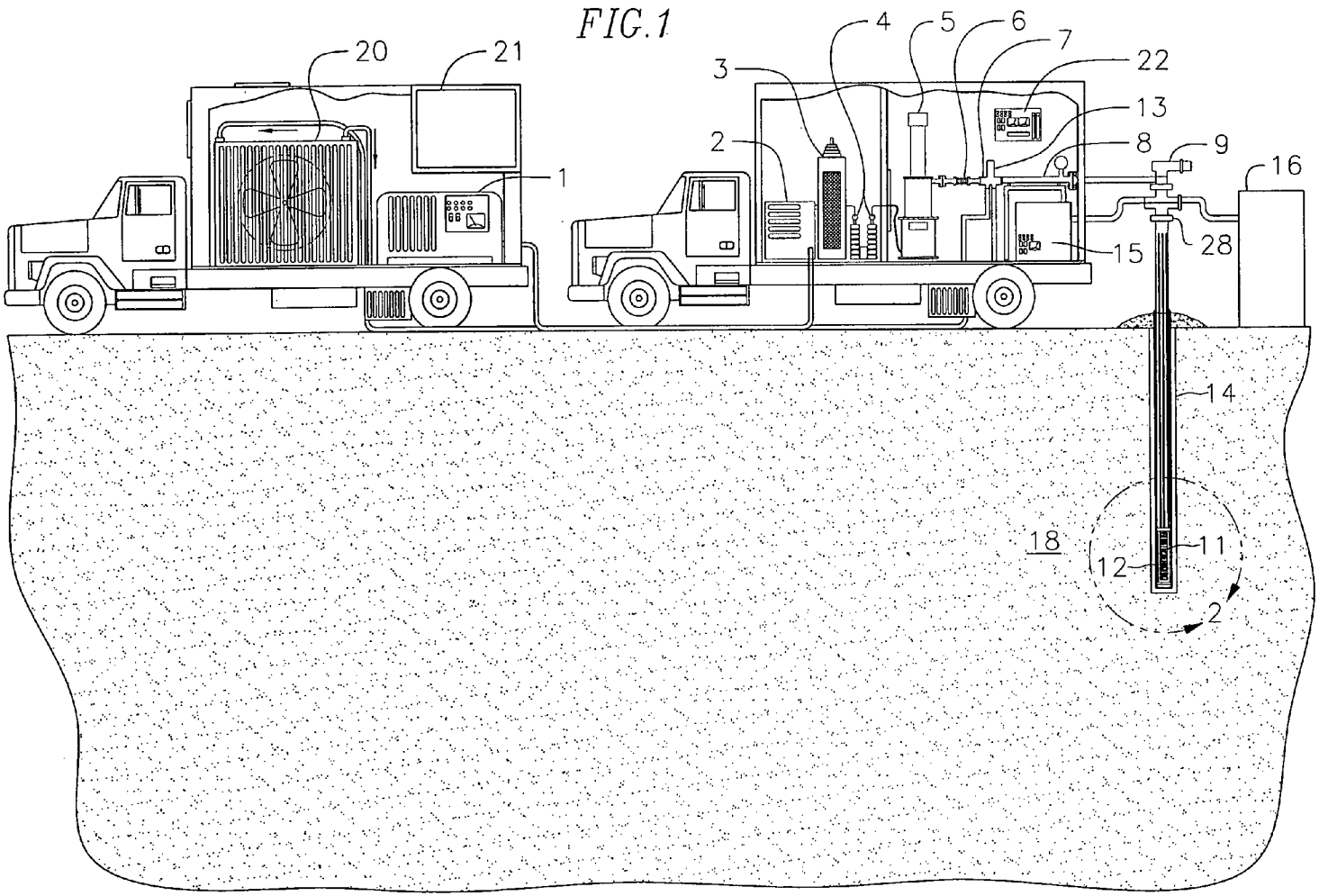
FIG. 1 is a diagrammatic illustration of a mobile microwave hydrocarbon recovery system, in accordance with this invention.
Figure 2:
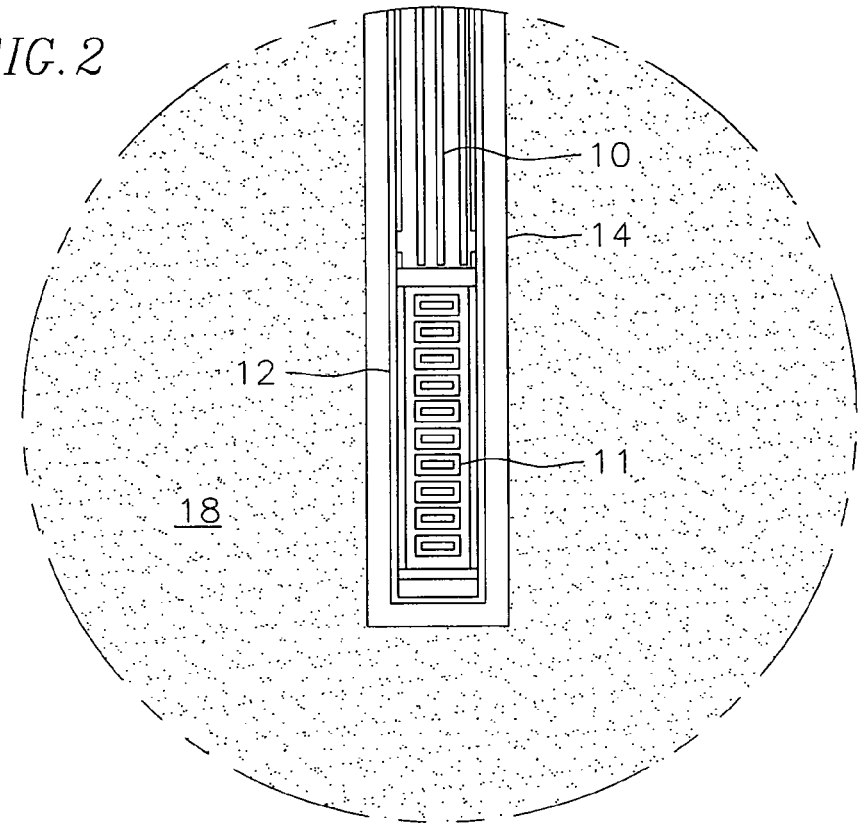
FIG. 2 is an enlarged view of the phase array antenna in the well, in accordance with this invention.

The specific embodiments of the hydrocarbon recovery system are illustrated in the drawings and will be described in detail herein. FIG. 1 illustrates the major components of a mobile hydrocarbon recovery system. A 400 cycle turbine generator 1, or some similar source, supplies electrical power for the system. The output of the generator 1 is applied to a transformer/filter unit 3 under the control of a control unit 2. A crowbar electrical circuit 4 at the output of the transformer/filter unit 3 prevents an over voltage condition at the output of the transformer/filter unit 3 from damaging circuits coupled to its output. Once triggered, crowbars 4 depend on overload-limiting circuitry, and if that fails, the system is protected by a line fuse or circuit breaker (not shown).

A high power (½ megawatt or greater) microwave source 5 (klystron) provides electrical energy down a waveguide 6. The source 5 may be a typical klystron with an efficiency between 40% and 50%. Preferably, the source is a sheet-beam klystron which has an efficiency close to 65%. The microwave energy travels through waveguide 6, past an arc detector 7, and through a circulator 8, to a mode converter 9. The mode converter 9 allows the microwave energy carried by waveguide 6 (which may be square or rectangular) to be carried by a water-cooled circular waveguide 10 or a coaxial cable (not shown). The microwave energy is directed downward into a specially designed well in a bore hole 14 via the water-cooled waveguide 10. The microwave energy is applied to a radiating antenna 11 which is located at a selected depth in a target formation 18.

Figure 5:
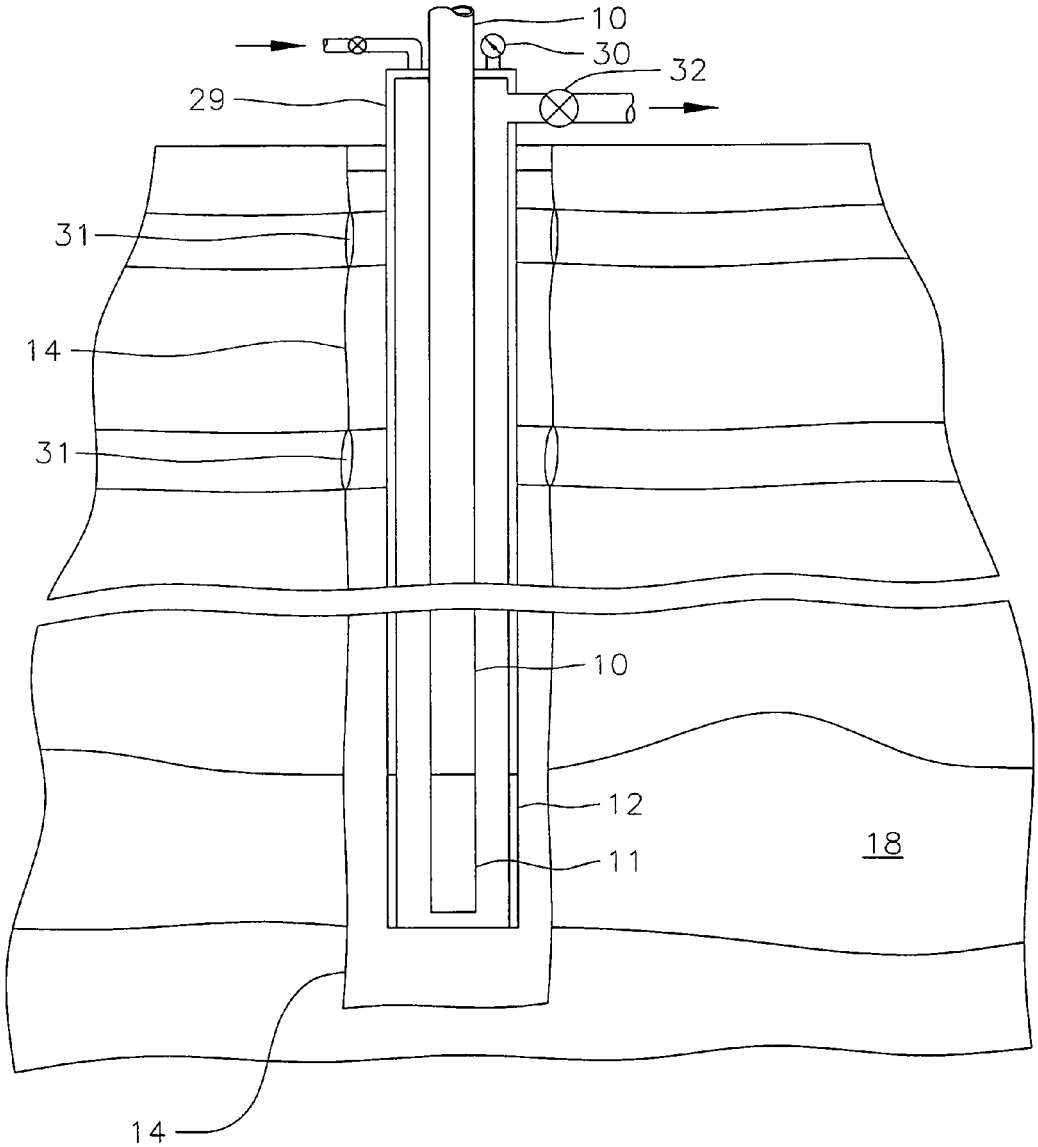
FIG. 5 is a diagram illustrating the typical stratification in many target formations containing hydrocarbons and a pressure controlled system, in accordance with this invention.

The antenna 11 and water-cooled waveguide 10 or coaxial cable are located in a specially designed bore hole 14 drilled to the target formation 18 which contains hydrocarbons. Standard drilling techniques are used to drill the bore hole to desired depths and diameters. The bore hole 14 passes through various stratified layers of soil, rock and water as schematically represented in FIG. 5. Selected layers, such as each layer of freely running water, are sealed off by concrete 31 or some other suitable seal to prevent contamination or other interference with the water or aquifers.

A casing 29 is placed inside the bore hole 14 and extends above the ground level and down into the hole 14 for nearly the entire depth of the hole.

A fused quartz well screen 12 extends from the bottom end of the casing 29. This screen 12 is perforated before attachment or may be perforated while in the hole 14.

The well screen 12 is located at the level of the target formation from which hydrocarbons are to be extracted.

Thus, in the hydrocarbon production zone, the radiating antenna 11 is contained in the perforated fused quartz well screen 12 or other low loss material. Preferably, the antenna 11 is a phase array antenna for directivity and control of the radiation pattern.

A circulator 8, having a series of ferrite magnets, is included in the waveguide 6 path to shift the phase and to shunt any power reflected from the target formation into a water-cooled dummy load 13, thereby protecting the klystron tube 5.

A water-cooling system consisting of a heat exchanger 20 and a coolant storage container 21 provide cooling water for the dummy load 13, circulator 8, klystron tube 5, waveguide 10 and antenna 11. The heat exchange 20 may operate at 2 Megawatts.

Arc detectors 7 are strategically placed in the waveguide to detect potential arcing problems and to immediately shut down the system if there is an arcing problem. The arc detectors 7 are integrated into a central control system 22 that monitors, but not limited to, cooling water temperatures, off-gas temperatures, off-gas concentrations, and power conditions for the power supply and the klystron, and provides safety controls for the operation of the system.

Electromagnetic energy is radiated either horizontally or angled upward, in a sector along the length of the antenna from the radiating antenna 11 and induces a phase boundary 17 into the surrounding rock of the target formation as the water and hydrocarbons are liquified or vaporized. This heating effect occurs due to microwave energy that is directly absorbed by the water and hydrocarbons in the phase boundary area 17. As subsurface water and hydrocarbon deposits in the phase boundary area liquify or vaporize, the phase boundary region expands resulting in a pressure gradient from the phase boundary to the encased well. Several atmospheres of pressure relative to the inside of the casing 29 and the bore hole 14, where the pressures are closer to atmospheric, may occur as a result of heating. A pressure gradient develops and thereby forces hot vapor from the subsurface, through the annular space of the casing 29, past an off-gas analyzer 15, and diverted to a thermal condenser tank 16 or a distillation unit for capture and hydrocarbon component separation.

The pressure in the area of the phase boundary 17 may be monitored by a gauge 30 near the top of the casing 29, which is closed at the top. See FIG. 5. The pressure may be controlled by varying the rate of flow of the material from the well by employing a valve 32 between the encased well and the thermal condenser and contaminated tank 16. The pressure may also be varied by varying the power level of the microwave source 5.

As an alternative to or in addition to pressure in the well, a sump near the bottom of the well with piping to the exterior of the well (not shown) may be used to recover the hydrocarbons and other liquids or gases from the bottom of the well.

An important effect of microwave radiation of rocks containing hydrocarbons and/or water is macro-fracturing of the rock over the area within the phase boundary 17. This effect significantly increases the intrinsic permeability of the rock, allowing the efficient egress of liquid and vapor from the phase boundary through the fractured rock and into the bore hole for collection.

The area within the phase boundary 17 is a preferential pathway for the migration of water and hydrocarbons (either in gas or liquid form) from the phase boundary 17 to the bore hole 14 and well screen 12. Consequently, vapor loss to the surrounding target formation is minimal as are potential environmental effects on any surrounding groundwater.

Figure 4:
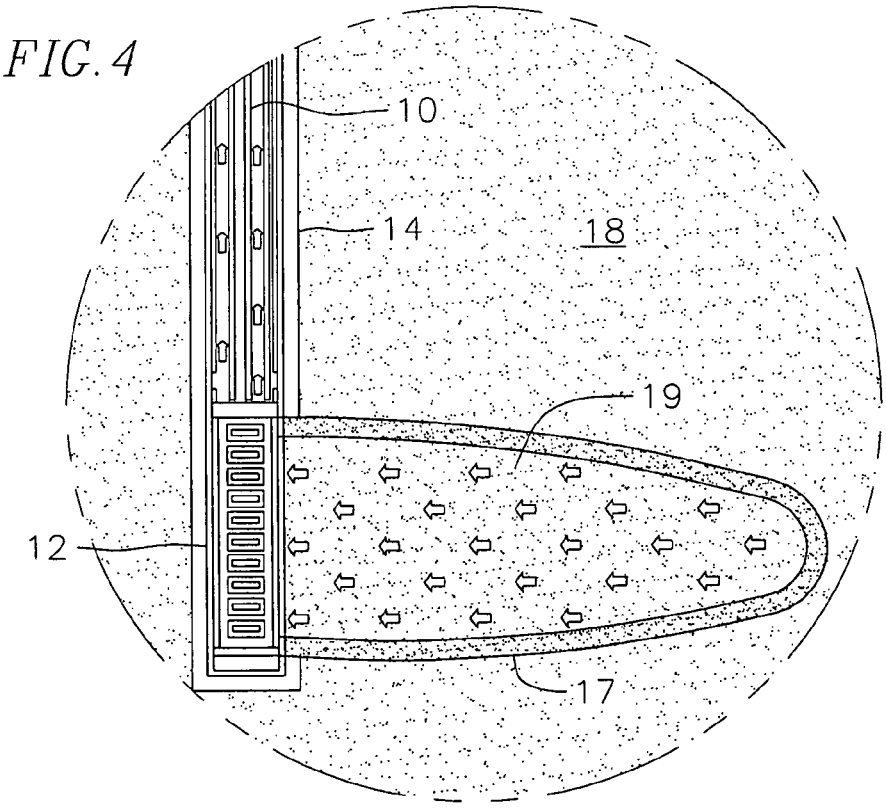
FIG. 4 is a cross-sectional view of the phase boundary from the energy radiated by the antenna, in accordance with this invention.
Figure 3:
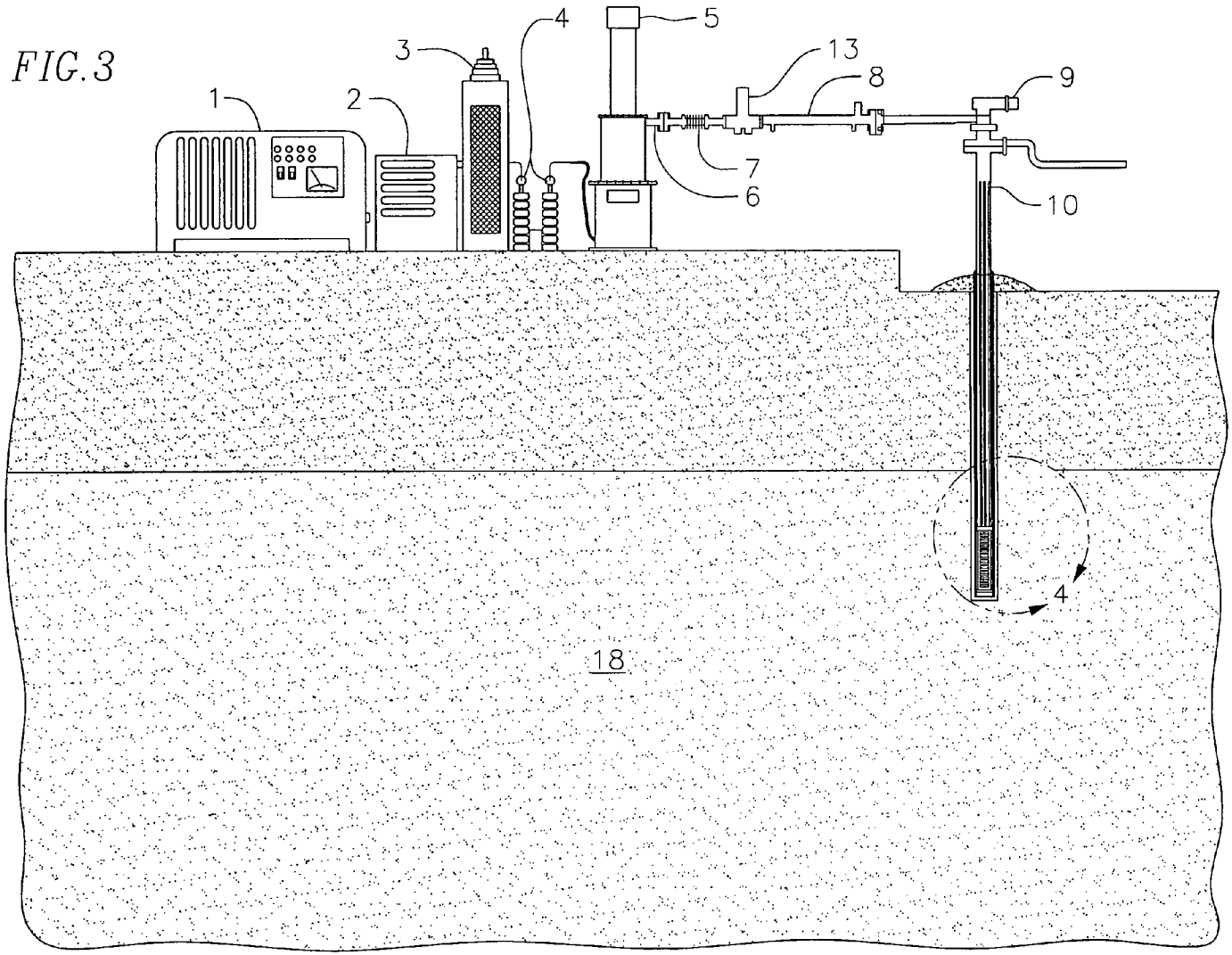
FIG. 3 is another view of the major components of the system, in accordance with this invention.

FIG. 4 provides a generalization of the phase boundary 17 launched into a target formation 18 by the phase array antenna 11. The phase boundary 17 is the location where microwave power is coupled with the water and hydrocarbons and are preferentially heated. As the water and hydrocarbons are vaporized or mobilized as a liquid resulting from microwave heating, the phase boundary advances into target formation 18. Water and hydrocarbon vapors migrate to the surface under the pressure gradient induced by microwave heating. Alternatively, a supplemental vacuum system is employed, if necessary. Additionally, extraction by conventional pumping may be used.

Once the phase boundary 17 has reached the maximum radial extent, the antenna 11 and water-cooled waveguide 10 are rotated around their vertical axes resulting in the antenna slots pointing in a different direction for extraction in a new sector. Another phase boundary 17 is created in the area adjacent to the previously microwaved region 19. The subtended angle of each sector is selected to most efficiently extract the desired hydrocarbons from the target formation. The smaller the angle the greater the energy in the sector. The angle may be 30° for most target formation. The process is continued until the majority of the region at a selected depth has been radiated in all directions. The antenna 11 is either raised or lowered in the bore hole 14 to another region in the target formation 18 and the process of launching phase boundaries in sequenced sectors is repeated. This process is continued until the distance of the phase boundary 17 from the antenna 11 results in diminishing hydrocarbon recovery rates which will dictate cessation of the process in that sector and eventually at the operating depth of the antenna and in the particular bore hole 14.

At this point in the process, the antenna 11 and water-cooled waveguides 10 are removed from the bore hole 14. A conventional oil recovery pump continues recovering liquid hydrocarbons until recovery rates cease. This process is repeated in additional bore holes spaced at approximately twice the electromagnetic propagation distance of the system.

Microwave heating has significant advantages over low frequency heating (generally less than 1.0 gigahertz) for the extraction of subsurface hydrocarbons. The imaginary part of the permittivity $\in_r''$ (the loss tangent) is a measure of how dissipative a medium is and gives the rate of attenuation to a propagating wave. In the lower RF frequency ranges, $\in_r''$ is dominated by ion conductivity. As rock is heated by a low frequency RF source, ions in groundwater will act as a charge carrier until approximately 100 degrees centigrade is achieved, depending on the system pressure, at which time the water will vaporize, terminating the charge carrier pathway. Further heating of the rock will rely on conduction that requires large energy inputs over substantial time periods to achieve desirable results. For example, kerogen locked in oil shale requires temperatures in the range of 450 to 500 degrees centigrade in order to liquify for removal. This requires an additional 350 to 400 degrees centigrade heating by conduction for RF frequency heating applications.

Conversely, microwave heating is caused by orientation polarization. In a lossy material, the electromagnetic energy is turned into heat by friction due to displacing internal charges when the material is polarized in place with the alternating electric field of the propagating microwave. Most rocks and soils are composed of aluminum silicates, calcium carbonates, quartz, or similar mineral compositions that exhibit low loss tangents for propagating microwave energy while water and hydrocarbons exhibit higher loss tangents. As a result, microwave energy can effectively penetrate various types of rock and directly couple energy into water and hydrocarbons resulting in a hydrocarbon removal process that is both effective and requires substantially lower quantities of electric power.

This process can be illustrated by comparing heating rates between conduction and microwave heating. A sample of oil shale placed in an 1100 watt microwave oven and heated for 3 minutes reaches an interior temperature of 103 degrees centigrade at 4 cm from the surface of the rock. Repeating the experiment in an 11,000 watt conventional oven at 260 degrees centigrade requires 22 minutes to reach the same temperature in the interior of the oil shale sample. The experimental results show dielectric heating by microwave frequency heats the oil shale over seven times faster at one tenth of the power requirement compared to thermal conduction heating.

The physical process of efficiently heating subsurface hydrocarbon deposits is based on the concept of launching a phase boundary in the subsurface using directed microwave energy, thereby heating the hydrocarbon to temperatures where liquification or vaporization occurs. As hydrocarbons are removed, the remaining rock absorbs limited amounts of energy allowing the phase boundary to continue to migrate radially from the access well.

The key to the migration of a microwave induced phase boundary to significant radial distances is the permittivity of dry rock and soil no longer containing water or hydrocarbon. Power attenuation in the dry rock or soil between the phase boundary and the well, the region where all of the hydrocarbons and water have been removed by heating, controls the radial distance that the phase boundary can migrate. In order to test the permittivity of dry rock and soils, a specially designed resonant cavity with a vector network analyzer and newly developed software capable of making accurate measurements down to $\in_r''/\in_r' < 10^{-5}$ were used to measure the permittivity on a variety of dry soil samples. Values of $\in_r'$, the real part of the permittivity, fall in the range of 2.6±0.1 and using very careful sample preparation, including temperature control, values for $\in_r''$, the imaginary part of the permittivity, showed repeatable minimum values as low as 0.006±0.001. It is believed the best asymptotic values produced to date lie near this limit.

Using these permittivity values with the microwave frequency (f) and the speed of light (c), it is possible to calculate the attenuation loss in the region of dry soil or rock in the microwave subsurface region using the following equation.

$$\varepsilon'' = 0.006$$

$$\varepsilon' = 2.6$$

$$f = 2.45 \times 10^9 \text{ l/s}$$

$$c = 2.997 \times 10^8 \text{ m/s}$$

$$\alpha = \frac{2\pi f}{c}\sqrt{\left[\frac{\varepsilon'}{2}\left(\sqrt{1+\left(\frac{\varepsilon''}{\varepsilon'}\right)^2}-1\right)\right]}$$

$$\alpha = 0.0955 \text{ l/m}$$

$$\text{Attenuation loss} = 8.6855\ d\alpha$$

$$\text{Attenuation loss } (\alpha_{DB}) = 0.829 \text{ db/m}$$

The power per unit area ($P_z$) flowing past the point z in the forward z-direction can be estimated using the following relationship:

$$P_z = P_0 e^{-2az}$$

where ($P_0$) is the power per unit area flowing past the point z=0, (α) is the attenuation coefficient, and (z) is the radial distance from the antenna. It is possible to estimate the skin depth, the distance at which the amplitude decreases to 1/e (≈37%) of its initial strength.

Figure 6:
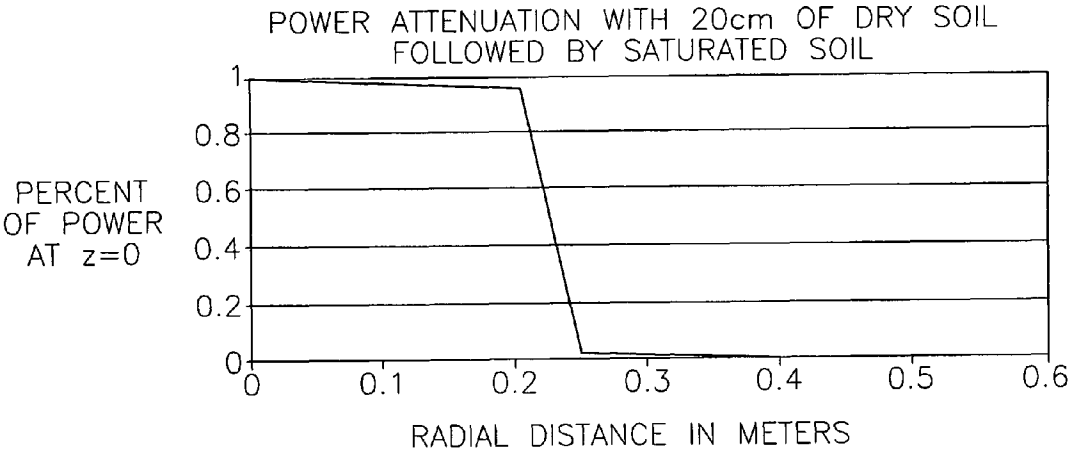
FIG. 6 is a diagram illustrating the microwave power penetrating dry soil followed by saturated soil, in accordance with this invention.

It is assumed that electromagnetic waves are incident on the soil sample that consists of 20 cm of dry soil and then wet soil. As shown in FIG. 6, microwave power penetrates the dry soil with negligible losses until it reaches the wet soil where nearly all of the power is absorbed in the first 10 cm of the wet soil which is the active heating zone. The ability to couple energy into a narrow area has several advantages including the enhancement of the rock's intrinsic permeability and the generation of steam.

Figure 7:
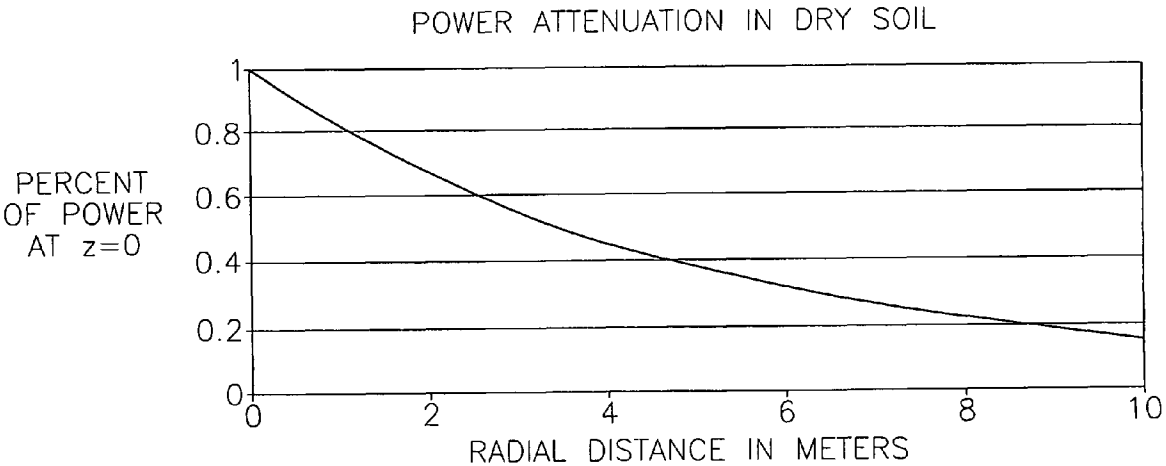
FIG. 7 is a diagram illustrating the power intensity in the dry soil, in accordance with this invention.

Once all of the water and hydrocarbons have been removed by microwave heating in the region between the antenna and the phase boundary, the power intensity can be calculated as a function of distance in the dry soil as illustrated in FIG. 7.

Nearly 15 percent of the power being radiated by the antenna is still available to heat the water and oil at 10 meters. With 2 megawatts of power radiating from the subsurface antenna, approximately 30 kilowatts of power is available for heating at this distance.

Only the permittivity of dry soils comprised of aluminum silicates and quartz were measured in the laboratory, however, microwave heating of selected natural minerals were performed by McGill and Walkiewicz (1987) and are presented in the following table.

| Mineral | Chemical composition | Temp, ° C. | Time, min |
|---|---|---|---|
| Albite | $NaAlSi_3O_8$ | 82 | 7. |
| Arizonite | $Fe_2O_3 \cdot 3TiO_2$ | 290 | 10. |
| Chalcocite | $Cu_2S$ | 746 | 7. |
| Chalcopyrite | $CuFeS_2$ | 920 | 1. |
| Chromite | $FeCr_2O_4$ | 155 | 7. |
| Cinnabar | HgS | 144 | 8. |
| Galena | PbS | 956 | 7. |
| Hematite | $Fe_2O_3$ | 182 | 7. |
| Magnetite | $Fe_3O_4$ | 1,258 | 2.75 |
| Marble | $CaCO_3$ | 74 | 4.25 |
| Molybdenite | $MoS_2$ | 192 | 7. |
| Orpiment | $As_2S_3$ | 92 | 4.5 |
| Orthoclase | $KAlSi_3O_8$ | 67 | 7. |
| Pyrite | $FeS_2$ | 1,019 | 6.75 |
| Pyrrhotite | $Fe_{1x}S$ | 886 | 1.75 |
| Quartz | $SiO_2$ | 79 | 7. |
| Sphalerite | ZnS | 87 | 7. |
| Tetrahedrite | $Cu_{12}Sb_4S_{13}$ | 151 | 7. |
| Zircon | $ZrSiC_4$ | 52 | 7. |

[a]Maximum temperature obtained in the indicated time interval.

It is possible to estimate the adsorption of microwave energy by comparing the permittivity measurement with the results presented by McGill and Walkiewicz (1987). Aluminum silicates such as albite and orthoclase show only minor heating in a microwave field consistent with the low permittivity values measured by the resonant cavity with the vector network analyzer. Quartz also showed results that are consistent with the published data and the laboratory measurements. For oil reservoirs in limestone or marlstone, typical of oil shale deposits, marble while metamorphosed is a similar composition. Marble exhibits limited heating in a microwave field which is consistent with other geologic material.

The directionality of the microwave beam produced by the phase array antenna and the enhanced intrinsic permeability of the region between the phase boundary and the well allow for specific targeting of hydrocarbon rich zones. The ability to target these zones allows for the efficient heating of subsurface hydrocarbon deposits while minimizing heat loss to less desirable subsurface units. Subsurface zones containing groundwater can be avoided thereby minimizing environmental impacts.

Stripper wells, defined as oil wells producing less than 10 barrels of oil per day, are limited in production due to low permeable formations surrounding the well. Commonly, the effective radius of the stripper well is limited to the radius of the well itself (e.g. commonly a 6 inch diameter well). Hydrofracturing is commonly used in the gas and petroleum industry to increase the permeability of the formation surrounding the well. Fluid is injected under high pressure into the well to induce fracturing along existing weakness in the rock such as bedding planes or small fractures. Small ceramic balls or similar materials are also injected to keep the fracture open during the production phase of the well.

The microwave system has the advantage of fracturing the entire rock formation surrounding a stripper well up to a radial distance of 10 meters. This "skin" zone surrounding the stripper well will exhibit an intrinsic permeability at least four orders of magnitude greater than the surrounding formation. Because of the rapid heating by the high power microwave system, extensive fracturing of lithofied rock can be expected to further increase the intrinsic permeability. Instead of oil flowing to an effective well radius of 6 inches, microwaved wells have an effective radius of up to ten meters. Modeling studies suggest that oil production rates from microwaved enhanced wells increase by over an order of magnitude.

Vast oil shale and tar sand deposits located around the world contain more oil than proven reserves in conventional oil fields. Present technologies to extract oil from these resources involve surface retorts or innovative subsurface heaters presently being tested by Shell Oil in Colorado. Microwave heating provides an efficient and environmentally sound method for the extraction of oil from these deposits and has several significant advantages both in costs, timing, and environment impacts.

Figure 8:
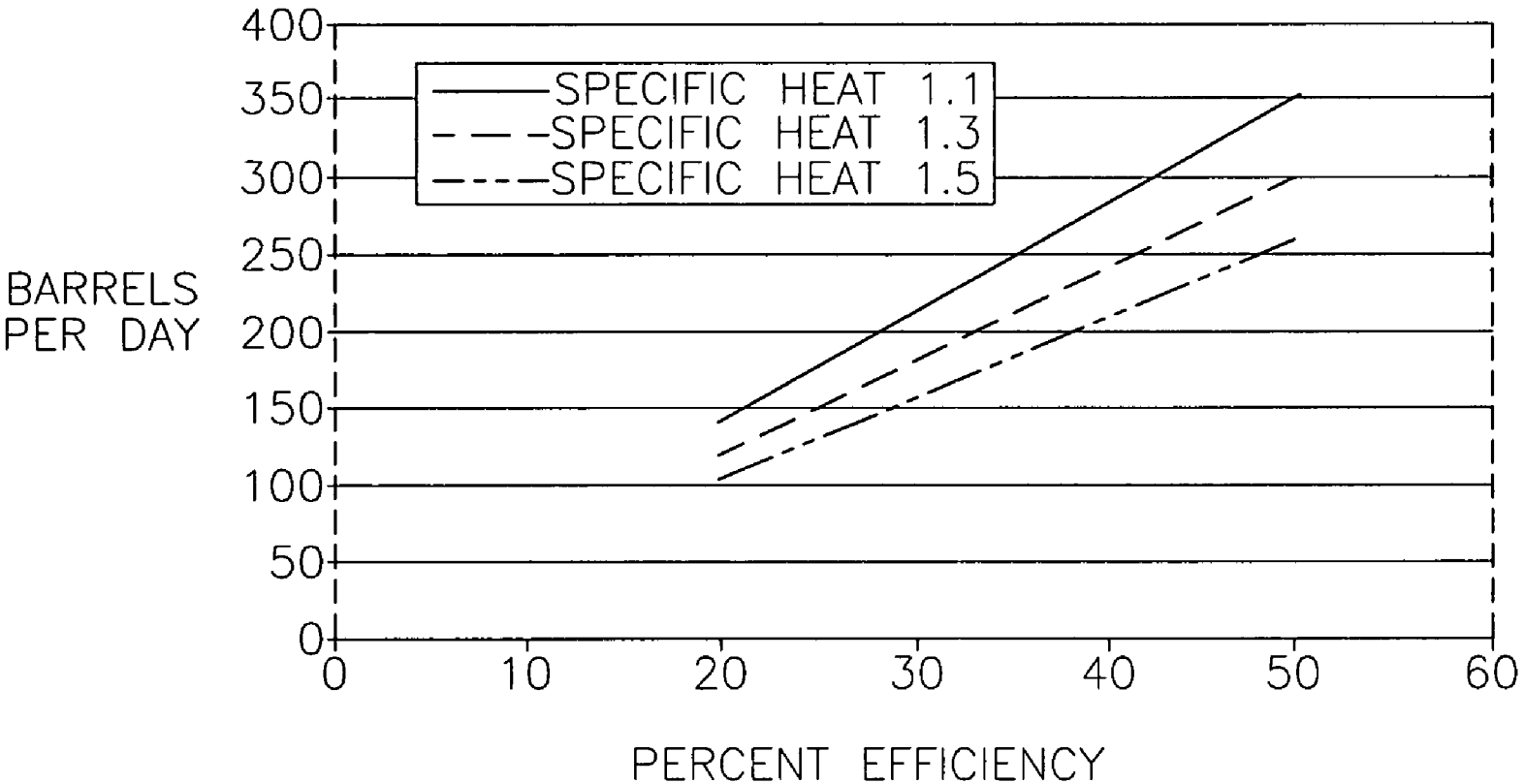
FIG. 8 is a diagram illustrating the power generation capacity of 4 MW and power efficiency rates ranging from 20 to 50 percent, in accordance with this invention.

The extraction of oil, assuming the use of a power generation capacity of 4 MW and power efficiency rates ranging from 20 to 50 percent, is shown in FIG. 8. Small losses will occur in the power supply and the waveguide, depending on depth. Klystron tubes proposed for the system are rated at a 65 percent efficiency. Therefore, for shallow extraction, less than 500 ft, the efficiency of the total system may be around 50 percent. Using the median value for specific heat of 1.3, the result is the production of approximately 300 barrels of kerogen per day from a single production well in the oil shale deposits. Similar production rates may be applicable to tar sand deposits.

Using the price of $60.00 per barrel of oil, with a 50 percent efficiency, and the most cost effective source of available power, the net result is that for every dollar spent on energy to power the microwave system an equivalent of approximately $6 of oil is extracted from the subsurface. This 6 to 1 ratio is double the ratio for current in-situ processes presently being tested in oil shale deposits. Further, the increased efficiency resulting from using some of the natural gas from a well to power the system is not included. In addition, oil will be produced almost immediately upon the application of microwave power to the subsurface instead of the three to four years required by other subsurface heating methods.

While the description above contains specificity, this should not be construed as limiting the scope of the invention; but merely as providing illustrations of the presently preferred embodiment of the invention. Although preferred embodiments and method for extracting subsurface hydrocarbons have been described above, the inventions are not limited to the specific embodiments, but rather the scope of the inventions are to be determined as claimed.

The invention claimed is:

1. A method of in-situ extraction of hydrocarbons from a selected layer of subsurface oil shale, tar sands, or conventional oil reservoirs comprising the steps of drilling a hole down to the selected layer of hydrocarbons and applying continuous microwave energy at frequencies greater than 2 GHz to a directional antenna positioned in the-selected layer and launching a narrow phase boundary that reduces the viscosity of the hydrocarbons to permit them to flow to the drilled hole.

2. The method in accordance with claim 1 comprising the further step of vaporizing a portion of the hydrocarbons in a narrow migrating phase boundary extending away from the antenna and creating a sufficient pressure differential between the phase boundary and the drilled well to push the hydrocarbons to the well.

3. The method in accordance with claim 1 comprising the further step of applying microwave energy at a density greater than ½ megawatt to vaporize a portion of the material in the phase boundary to create a pressure differential between the area in the phase boundary and the drilled well.

4. Apparatus for extracting hydrocarbons from a subsurface target formation comprising a continuous source of microwave power equal to or greater than one-half Megawatt, a directional antenna positioned in the target formation, a waveguide or coaxial cable coupling the microwave energy from the source to the antenna, and a phase boundary radiating away from the antenna for reducing the viscosity of the hydrocarbons.

5. Apparatus in accordance with claim 4 further comprising a dummy load and a recirculator to shunt reflected energy to the dummy load.

6. Apparatus in accordance with claim 4 further comprising a mode converter between the source and the antenna.

7. Apparatus in accordance with claim 6 further comprising a rotator between the mode converter and the antenna for rotation of the antenna to change the direction of radiation.

8. Apparatus in accordance with claim 4 wherein the source operates at a frequency above 2 Gigahertz.

9. Apparatus in accordance with claim 4 wherein the apparatus is field portable.

10. A system for in-situ extraction of hydrocarbons from a target formation comprising a hole drilled down to and including the target formation, a casing in the hole, the casing being closed at the top above ground and having a well screen of low loss material at the lower end in the target formation, a source of microwave energy, a radiating antenna positioned in the casing at the target formation, means for coupling the source to the antenna for creating and launching a phase boundary in the target formation and a valve coupled to the top of the casing to control the pressure in the hole.

* * * * *